US007060923B2

(12) United States Patent
Pihlaja

(10) Patent No.: US 7,060,923 B2
(45) Date of Patent: Jun. 13, 2006

(54) KEY

(75) Inventor: Pekka Pihlaja, Helsinki (FI)

(73) Assignee: Nokia Corporation, Espoo (FI)

( * ) Notice: Subject to any disclaimer, the term of this patent is extended or adjusted under 35 U.S.C. 154(b) by 16 days.

(21) Appl. No.: 10/865,239

(22) Filed: Jun. 10, 2004

(65) Prior Publication Data

US 2005/0274595 A1 Dec. 15, 2005

(51) Int. Cl.
*H01H 1/10* (2006.01)

(52) U.S. Cl. ..... 200/512; 200/513; 338/47; 338/114

(58) Field of Classification Search ..... 338/47, 338/95, 114; 200/512, 510, 513
See application file for complete search history.

(56) References Cited

U.S. PATENT DOCUMENTS 5,949,325 A * 9/1999 Devolpi ..... 338/154
6,067,005 A * 5/2000 DeVolpi ..... 338/47

FOREIGN PATENT DOCUMENTS

EP 0 414 540 B1 7/1997

* cited by examiner

*Primary Examiner*—Kyung Lee
(74) *Attorney, Agent, or Firm*—Hollingsworth & Funk, LLC

(57) ABSTRACT

A key has a varying response depending on the manner of depression. The key comprises at least a base and a switching element arranged curved relative to one another. Between the switching element and the base is a contact area where the switching element touches the base. When the switching element is depressed towards the base, the edge of the contact area between the switching element and the base moves along the surface of the base. The response of the switch is determined by observing the location of the edge of said contact area relative to the base.

15 Claims, 2 Drawing Sheets

KEY

BACKGROUND OF THE INVENTION

The invention relates to a key for feeding information into a device.

The invention further relates to a computer program product for controlling a data processing device in response to the execution of a program code comprised by the computer program product in a processor of the data processing device.

EP publication 0 414 540 discloses a capacitive sensor. The problem in the publication is how to observe how fast a key is depressed downward and how hard the key is depressed after it is depressed to the bottom. The publication discloses a key with which a plastic arc is depressed downward via a key lever. The plastic arc is resilient and its lower surface is provided with projections. A capacitive sensor is arranged in connection with the plastic arc. The solution is quite complex and difficult to implement.

BRIEF DESCRIPTION OF THE INVENTION

The object of the present invention is to provide a new type of key and software for reading the information fed by the key.

The keyboard of the invention is characterized in that the key has a varying response dependent on the manner of depression, the key comprising at least a base and a switching element arranged curved relative to one another such that a contact area is provided between them, where the switching element touches the base, and when the switching element is depressed towards the base, the edge of the contact area between the switching element and the base moves along the surface of the base, and the response of the switch is determined by observing the location of the edge of said contact area relative to the base.

Furthermore, the computer program product of the invention is characterized in that the computer program product comprises program code which, when executed in a processor of a computer, makes the device read the information fed by the key by processing a measurement result that observes the location of the edge of the contact area between the switching element and the base of the key relative to the base.

The essential idea of the invention is that the key has a varying response dependent on the manner of depression and the key comprises at least a base and a switching element arranged curved relative to one another. When the switching element is depressed towards the base, the edge of the contact area between the switching element and the base moves along the surface of the base. The response of the key is determined by observing the location of the edge of said contact area relative to the base. The idea of an embodiment is that the key comprises a curved flap whose first end, i.e. root, is in contact with the base, the second end, i.e. the tip, being detached from the surface of the base. When the tip of the flap is depressed downward, its point of contact where the bottom of the flap starts to touch the base moves towards the tip of the flap. Accordingly, when the flap is depressed downward, the point of contact moves along the surface of the base. The key information is thus read according to the point of contact of the key by observing the contact between the flap and the base. This enables the implementation of a simple key structure in a small space. Said structure enables the input of varying information with one key into the device used. The contact can be observed by a linear resistor, enabling a very simple structure. The idea of an embodiment is that there is no separate key cup on top of the flap of the key or the key cup on top of the flap is of a soft material. This allows information to be input by gliding a finger along the key, which is particularly accurate. In this case, the concavely curved flap settles suitably against the finger and brings a sense of touch to the usage.

BRIEF DESCRIPTION OF THE FIGURES

The invention will be described in more detail in the attached drawings, wherein.

In the figures, the invention is presented in a simplified manner for the sake of clarity. In the figures, like parts are designated by like reference numerals.

DETAILED DESCRIPTION OF THE INVENTION

Figure 1:
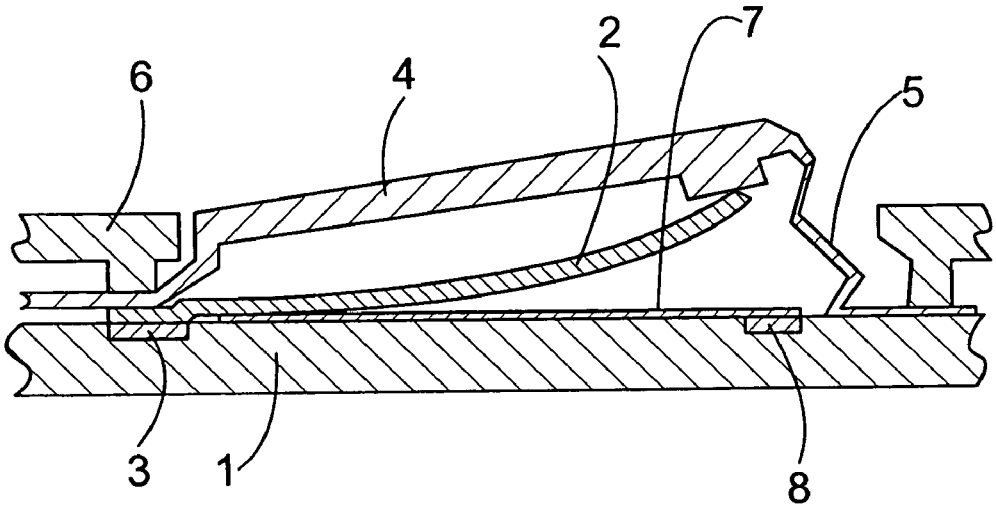
FIG. 1 is a schematic side view in section of a key.

FIG. 1 shows a printed wire board 1 on top of which a flap 2 acting as a switching element is arranged. The flap 2 is attached at the root to the printed wire board 1, acting as the base, at a first contact point 3. The flap 2 is preferably of steel, but yet of such a thin material that it is flexible. The flap 2 is made concavely curved, its one end, i.e. the tip, being detached from the surface of the printed wire board 1 under a normal state, as FIG. 1 shows. As shown in FIG. 1, the flap 2 is concavely curved and has an even bottom. On top of the flap 2 is arranged a rigid key cup 4. The key cup 4 is hinged at the root, i.e. close to the root of the flap 2. At one end of the key cup 4 is a key mat 5, which protects the parts under the key cup 4 against dust and other dirt. However, the key mat 5 is arranged flexible such that the key mat 5 in no way complicates the movement of the tip of the key cap 4 downward from the position shown in FIG. 1.

Outside the keyboard structure is arranged a cover 6. Under the flap 2 is arranged a linear resistor 7. At one end of the linear resistor 7 is a second contact point 8.

When the rigid key cup 4 is depressed downward, the key cup 4 presses the tip of the flap 2 downward. Since the flap 2 is curved, it first depresses at its root and when being further depressed, increasingly more starting from the root in a larger area against the linear resistor 7. The fact how much the key is depressed downward is easily observed by measuring the resistance between the first contact point 3 and the second contact point 8. Said resistance decreases as the contact area between the flap 2 and the linear resistor 7 increases, i.e. as the edge of the contact area moves. This enables very simple observation of how much force is used to depress the key and/or of how much the key is depressed downward.

The strength curve of the key can be made logarithmic by making the curve of the flap 2 such that it becomes steeper towards the tip. Accordingly, in this case, clearly more strength is required for depressing the key when the tip of the flap 2 is close to the printed wire board 1 as compared with a situation when the depression of the key is initiated when the flap 2 is in the upper position.

The linear resistor 7 can be made for instance of conductive rubber, whereby a good contact between the flap 2 and the linear resistor 7 is ensured. If required, the root of the flap 2 may be directly fastened to or at least in continuous contact with the linear resistor 7.

The key can be constructed by simultaneously constructing a keyboard comprising a plurality of keys. In this instance, a plate of the size of the entire keyboard or at least of the size of several keys is first generated. Said plate can be a steel plate, for example. The steel plate can be of spring steel, for example. The thickness of the steel plate can be between 0.05 and 0.30 mm, for example. The thickness of the steel plate can be 0.15 mm, for example. Instead of steel, the plate can be of another sufficiently elastic and durable material, such as rubber or another suitable material. The flap 2 is cut in the plate, and the flap 2 is bent upward from the surface of the plate. The flap 2 is thus created such that it is cut off the plate at three of its sides and is attached to the plate at one side. The key can be created by one working phase by punching the key from the plate. In other words, the flap 2 can be cut off the plate at three sides with a pressing device and simultaneously the free end of the flap 2 is bent in an upward position.

The keyboard may be a separate keyboard connected with a line or wireless connection to a device, such as a computer. On the other hand, the keyboard can be arranged directly in connection with a device, such as a mobile phone or another mobile station, a portable computer, a pocket calculator or another corresponding device. The key is particularly well suitable for use in portable devices, which are often small and have no space for large structures or structures consuming much energy, but the simple key structure according to the invention, which is easily implemented, is very well suited to them. The key is particularly well suitable for use in connection with games and other entertainment technology. When a key is used in a game, information is often required about how much or how hard the key is depressed, making the solution of the invention extremely well suitable for said use, since it does not require structures as complex as for instance a digital key arranged for similar use.

Figure 2:
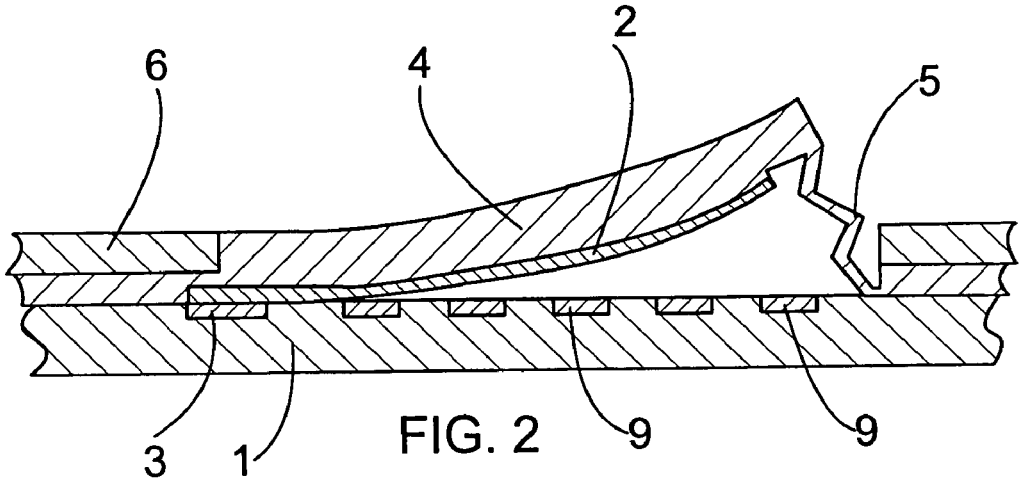
FIG. 2 is a schematic side view in section of a second key.

FIG. 2 shows a solution with the key cup 4 made of a soft material. This allows the key to be used for very exact observation of the point up to which the flap 2 is depressed against the printed wire board 1. The tip of the finger can be glided along the key cup 4, allowing the location of the finger to be observed very accurately. Observation of the location enables a much more accurate response about the input information than does observation of a downward depression.

In the solution of FIG. 2, a plurality of successive detector contacts is arranged instead of the linear resistor 7. In other words, the contact area is observed by observing how many detector contacts 9 the flap 2 touches. Accordingly, in the case of FIG. 1, a purely analog observation is concerned, whereas in the case of FIG. 2, the observation occurs digitally, in principle. However, if there are sufficiently frequently arranged detector contacts 9, information can be processed extremely well in the solution of FIG. 2 almost in the same way if the observation were to take place fully analogically.

The key may also be implemented by making the flap 2 of a conductive rubber, whereby the key cup 4 and the flap 2 thus constitute an entirely rubber structure.

An alternative is to have no key cup on top of the flap 2. Even in this case, gliding a finger on top of the flap 2 enables the input of information, by means of which one is able to interpret how long the finger has been glided along the key.

Figure 3:
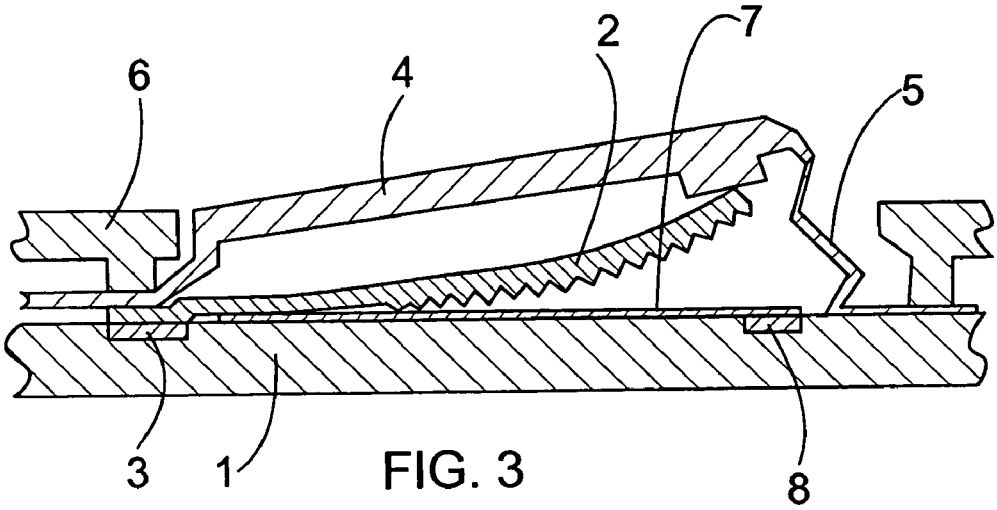
FIG. 3 is a schematic side view in section of a third key.

The structure of the key shown in FIG. 3 mainly corresponds to the key shown in FIG. 1. In the key of FIG. 3, the bottom of the flap 2 is not even, but serrated. Thus, the contact area between the flap 2 and the linear resistor 7 changes according to how many tip parts of the serrated bottom touch the linear resistor 7.

Figure 4:
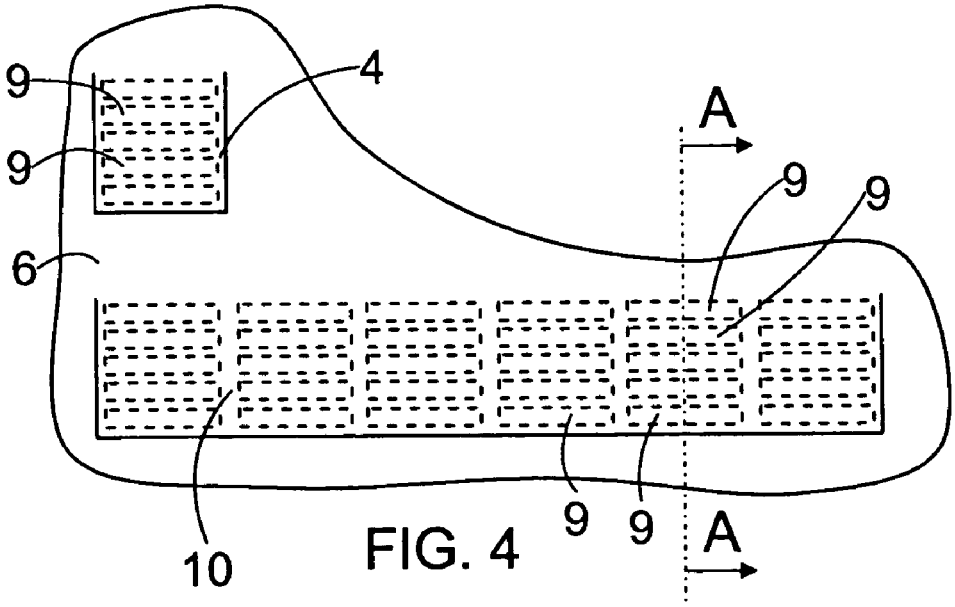
FIG. 4 is a schematic top view of a key and a key providing a key strip.

FIG. 4 is a top view of a single key and a key constituting a key strip 10. Only the key cap 4 is shown of a single key. The key constituting a key strip 10 is arranged significantly broader than a single key.

In FIG. 4, a broken line also illustrates detector contacts 9. In connection with a single key, the detector contacts 9 are thus as broad as the key. Accordingly, the key strip 10 is considerably broader than a single key, and the detector contacts 9 are arranged in the form of a matrix. The key strip 10 is arranged flexible also laterally, i.e. when the key strip is depressed at its first end, it presses downward, but the key strip 10 is not, however, entirely, i.e. in its middle and its second end, pressed downward. Furthermore, when being depressed in the middle, the middle of the key strip presses downward, but not at either ends. Arranging the detector contacts 9 as a matrix enables the observation of how much the key strip is depressed and also at which point or points the key strip 10 is pressed downward. Consequently, as regards a single key, when a flexible key cap is used, the position of the finger in one direction can be observed, whereas a key strip enables the observation of the position of the finger two-dimensionally, i.e. in the longitudinal and transverse directions of the key strip. As far as the cross section A—A is concerned; the key strip 10 is similar to the cross section of the key shown in FIG. 2.

Figure 5:
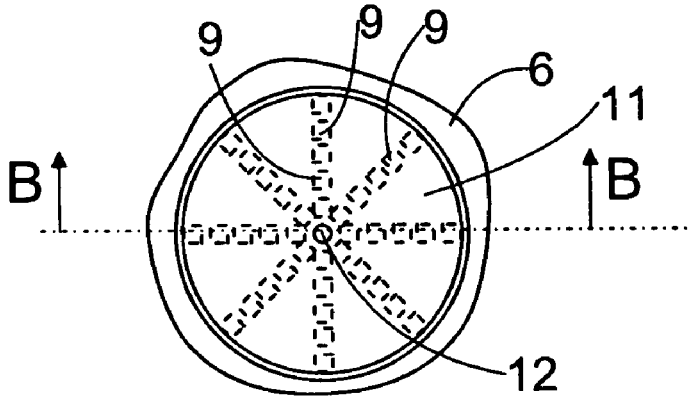
FIG. 5 is a schematic top view of a key providing a joystick.
Figure 6:
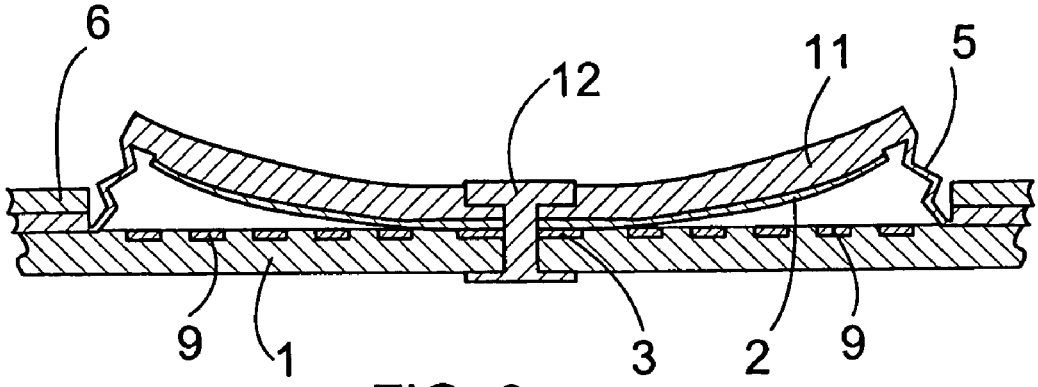
FIG. 6 is a schematic section of the key of FIG. 5 taken along line B—B of FIG. 5.

FIG. 5 is a top view of a key constituting a joystick 11. In a way, the joystick 11 is similar to the key strip 10 shown in FIG. 3, but it is arranged in the form of a circle. FIG. 4 also illustrates detector contacts, which can be utilized to also enable the observation of how strongly the joystick 11 is depressed and at which point, i.e. in which direction. In the middle of the joystick 11 is a rivet 12 with which the key is fastened to the printed wire board 1.

Both the joystick 11 and the flap 2 may be of rubber, for example, allowing the joystick 11 to be depressed for instance simultaneously on opposite sides. On the other hand, the flap 2 can also be rigid, whereby it is inclined in the middle such that the opposite side rises upward when the second edge is depressed. In this case, when the key is depressed, the contact area does not increase, but key information, i.e. key response, is determined even in this case by observing the location of the edge of the contact area relative to the base. The flap 2 can also be arranged to buckle when being depressed at the edge, allowing an extremely clear tactile effect to be given to the user.

Accordingly, if desired, the flap 2 can be annular, as is the joystick 11 shown in FIG. 4. The joystick according to FIGS. 4 and 5 can also be arranged such that for instance four or more flaps 2 are placed radially in different directions, and on top of them is placed an integrated annular key cap similar to the joystick according to FIG. 4.

The device in the connection with which the key is arranged comprises a computer program for reading the information input by the key. The program comprises program code, which, when executed in a processor, makes the device process the measurement result, with which the location of the edge of the contact area between the switching element and the base relative to the base is observed. This information thus indicates how much the key is depressed, the information being led to further utilization. A data processing device comprises at least a memory circuit comprising a computer program for controlling the device and a memory means for storing the information. The device further comprises a processor controlled by a computer program, whereby the processor implements the desired measures. The computer program code may also be loaded from a memory inside the device. The computer program code can also be transferred to the device from a separate exterior memory means, such as a diskette or a CD-ROM. It may also be transferred via a communications network, for instance by connecting the device via a wireless access network to the Internet. The use of a hardware implementation or a combination of hardware and software solutions is also feasible.

The drawings and the related description are only intended to illustrate the inventive idea. The details of the invention may vary within the scope of the claims.

The invention claimed is:

1. A key for feeding information into a device, the key having a varying response dependent on the manner of depression, the key comprising at least a base and a switching element arranged curved relative to one another such that a contact area is provided between them, where the switching element touches the base, and when the switching element is depressed towards the base, the edge of the contact area between the switching element and the base moves along the surface of the base, and the response of the switch is determined by observing the location of the edge of said contact area relative to the base;

wherein the switching element comprises a flexible flap having a first end, i.e. a root, and a second end, i.e. a tip, the flap having a curved shape, the flap being in contact with the base at the root while the tip is detached from the surface of the base, wherein the edge of the contact area moves towards the tip of the flap and the contact area increases when the tip of the flexible flap is depressed downward.

2. The key of claim 1, wherein the galvanic contact between the switching element and the base is observed.

3. The key of claim 1, wherein the key comprises a linear resistor in connection with the base.

4. The key of claim 1, wherein the key comprises detector contacts in connection with the base.

5. The key of claim 1, wherein a key cup of a soft material is arranged on top of the key, or no separate key cup is arranged on top of the key, allowing information to be input by gliding a finger along the key.

6. The key of claim 1, the key being arranged broad enough to constitute a key strip allowing the information input to be observed two-dimensionally, i.e. in the longitudinal and transverse directions of the key strip.

7. The key of claim 1, the key comprising a plurality of curved flaps arranged radially in different directions such that the key constitutes a joystick enabling the observation of how strongly and in which direction the key is depressed.

8. The key of claim 1, the key comprising an annular flap, the key constituting a joystick for observing how strongly and in which direction the key is depressed.

9. The key of claim 1, the key being a key of a mobile station.

10. The key of claim 1, wherein the base is a printed wire board.

11. The key of claim 1, wherein the flap is fastened to the base at its root.

12. The key of claim 1, wherein the flap has an even bottom.

13. The key of claim 1, wherein the galvanic contact between the switching element and the base is observed.

14. The key of claim 1, wherein the key comprises a linear resistor in connection with the base.

15. The key of claim 1, wherein the key comprises detector contacts in connection with the base.

* * * * *